United States Patent [19]

Durham

[11] 4,373,850

[45] Feb. 15, 1983

[54] AUTOMATIC FUEL CONTROL SYSTEM

[76] Inventor: M. E. Durham, 4 Rangeview Cir., Greenville, S.C. 29611

[21] Appl. No.: 121,633

[22] Filed: Feb. 14, 1980

[51] Int. Cl.[3] ..... E02F 3/74

[52] U.S. Cl. ..... 414/699; 60/431; 123/386

[58] Field of Search ..... 414/699; 60/431, 445; 92/8, 143; 123/386, 385

[56] References Cited

U.S. PATENT DOCUMENTS

| | | | |
|---|---|---|---|
| 2,986,291 | 5/1961 | Shick | 414/699 |
| 3,148,790 | 9/1964 | Ziskal | 414/699 |
| 3,542,228 | 11/1970 | Horsch | 414/699 |
| 3,606,099 | 9/1971 | Gordon | 414/699 |
| 3,792,791 | 2/1974 | Fleming | 414/699 |
| 3,901,395 | 8/1975 | King | 414/699 |

*Primary Examiner*—Charles J. Myhre
*Assistant Examiner*—Carl Stuart Miller

[57] ABSTRACT

A system for automatically regulating the fuel supplied to the engine of a mobile construction machine which has a hydraulic pump driven by the engine. A tool is carried by the machine for performing work functions and hydraulic cylinders are provided for manipulating the tool responsive to pressurized fluid being supplied to the hydraulic cylinders. A manually operated valve mechanism is provided for controlling the flow of hydraulic fluid between the hydraulic pump and the hydraulic cylinders. A lever arm regulates the flow of fuel to the engine. The lever arm can be manually manipulated or it can be manipulated automatically by means of a double action cylinder. A piston rod extending from the double action cylinder is connected to the lever arm so that the fuel supplied to the engine is regulated responsive to changes in pressure in the hydraulic system. Bypass openings are provided in the piston of the double action cylinder so as to permit the lever arm to be either manipulated manually or automatically. Valves are provided for controlling the flow of hydraulic fluid to either a reservoir or the double action cylinder.

6 Claims, 3 Drawing Figures

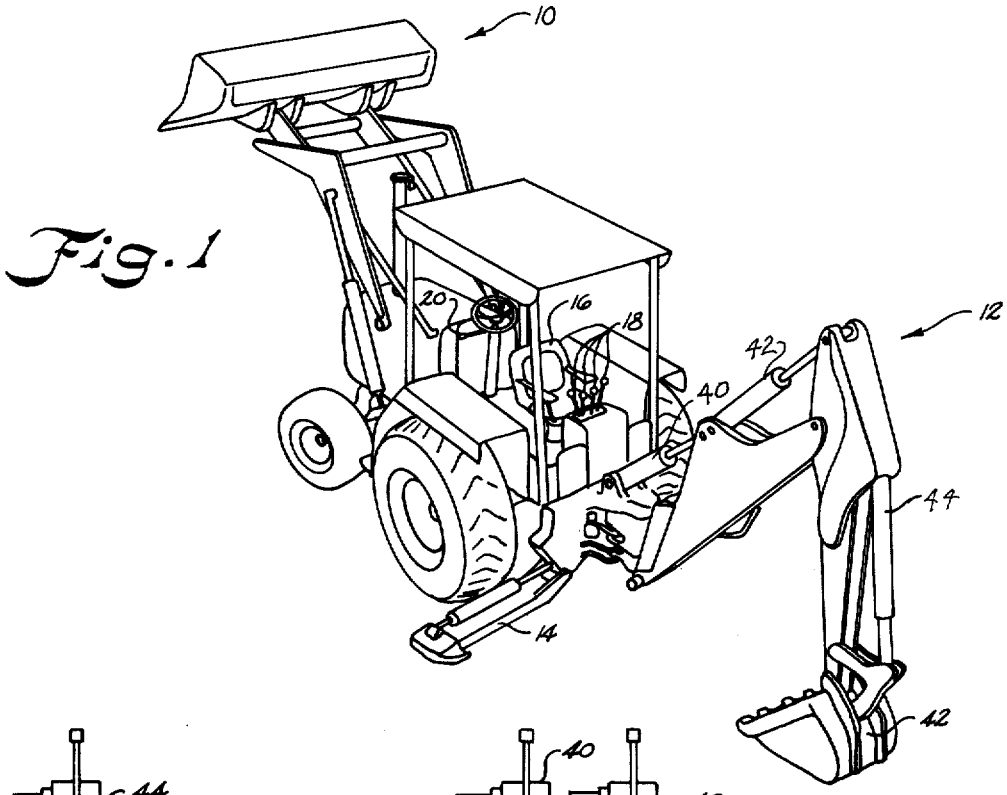
Fig. 1
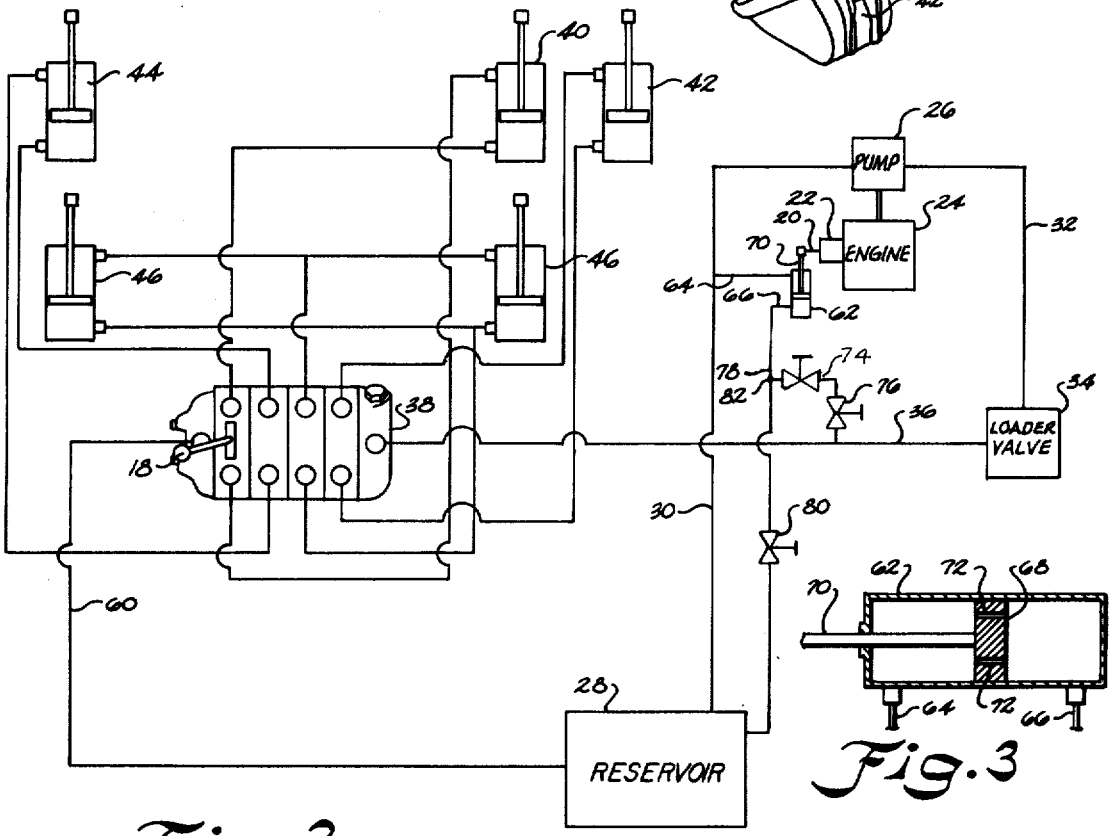
Fig. 2
Fig. 3

AUTOMATIC FUEL CONTROL SYSTEM

BACKGROUND OF THE INVENTION

Heretofore, on most conventional tractors and mobile construction machines such as backhoes, the operator when working the hydraulic tools associated with the equipment, normally place the throttle for the engine close to maximum. This ensures sufficient power for operating the hydraulic pump for supplying pressurized hydraulic fluid to the cylinders used for manipulating the tools. One problem with such a method of operation is that when the tool was not being used, either momentarily or for longer periods of time, the engine would often be allowed to continue running at maximum throttle consuming a substantial amount of fuel as well as producing unnecessary wear thereon.

There are several devices shown in patents for regulating the fuel to internal combustion engines used in tractor vehicles responsive directly to load requirements for automatically permitting additional fuel to be delivered to the engine. Examples of such devices are disclosed in U.S. Pat. Nos. 2,986,291, 3,542,228, 3,901,395, 3,792,791, 3,606,049 and 3,148,790. The majority of these systems appear to be quite complicated compared to the simple construction of applicant's device.

SUMMARY OF THE INVENTION

Accordingly, it is an important object of the present invention to provide a system for automatically regulating the fluid supplied to an engine of a mobile construction machine responsive to the load requirement of a hydraulically operated tool.

Still another important object of the invention is to provide a system for automatically regulating the fuel supplied to an engine of a mobile construction machine responsive to the load requirement of a tool provided on a machine without adversely affecting the manual operation of a throttle for the engine.

Still another important object of the present invention is to provide an apparatus for maximizing the response time between the load requirement on a hydraulically operated tool and increasing the fuel supply to an engine for supplying added pressurized hydraulic fluid to the hydraulic cylinder associated with the tool.

In accordance with the present invention, a system is provided for automatically regulating the fuel supplied to the engine of a mobile construction machine that has a hydraulic pump driven by the engine. A tool is carried by the machine for performing work and at least one hydraulic cylinder is provided for manipulating the tool responsive to pressurized fluid being supplied to the hydraulic cylinder from the hydraulic pump. Hydraulic lines extends between a fluid reservoir, the hydraulic pump, and the hydraulic cylinder. A manually operated valve mechanism is provided for controlling the flow of hydraulic fluid between the hydraulic pump and the hydraulic cylinder. A lever arm is provided for regulating the flow of fuel to the engine. The lever arm may be directly connected to the engine or connected to a fuel injector pump associated with the engine. A double action cylinder is provided for manipulating the lever arm responsive to changes in hydraulic pressure being supplied to the cylinder associated with the tool. The double action cylinder includes a piston having a rod extending out the end thereof that is connected to the lever arm for moving the lever arm responsive to the movement of the piston. A hydraulic line is connected between the valve mechanism and the hydraulic pump and a fluid port of the double action cylinder for shifting the piston responsive to the movement of the manually operated valve mechanism. Bypass openings are provided in the double action cylinder allowing bleed through of fluid from one side of the piston to the other side for minimizing the response time for movement of the piston responsive to pressurized hydraulic fluid being supplied to the hydraulic cylinder.

First and second valves are interposed in hydraulic lines extending between the double action cylinder and the reservoir for balancing the flow of hydraulic fluid between the reservoir and the double action cylinder. As a result, the response time of the double action cylinder can be regulated. Also by manipulating these two valves, the time that is required for the throttle lever to return to its idle position can be adjusted.

BRIEF DESCRIPTION OF THE DRAWINGS

FIG. 1 is a perspective view illustrating a typical mobile construction machine upon which a system constructed according to the present invention can be utilized.

FIG. 2 is a flow diagram illustrating a system constructed in accordance with the present invention.

FIG. 3 is an enlarged sectional view illustrating the double action system utilized in the system of FIG. 2.

DESCRIPTION OF A PREFERRED EMBODIMENT

Referring to FIG. 1, there is illustrated a conventional tractor equipped with a front end loader generally designated by reference character 10 and a backhoe generally designated by the reference character 12. Hydraulically maneuvered stabilizers 14 are also provided on the tractor.

When operating the backhoe 12, the operator normally sits in a chair 16 and manipulates levers 18 for supplying hydraulic fluid to selective cylinders in order to cause the bucket and backhoe to move in different directions. All of the hydraulic cylinders that are used for maneuvering the backhoe are not shown in FIG. 1; however, they are shown in the flow diagram of FIG. 2.

A throttle lever 20 is provided for controlling the flow of fuel through a fuel injector pump 22 for increasing the output of the engine 24 of the tractor. Positioned on the output shaft of the engine 24 is a hydraulic pump 26. A reservoir 28 is connected by means of a hydraulic line 30 to the pump 26 for supplying hydraulic fluid to the pump. The pressure output of the pump 26 varies according to the speed of the engine 24.

Normally, as previously mentioned, an operator of the tractor shown in FIG. 1 places the throttle at close to maximum. This ensures that the pump 26 is producing the maximum hydraulic fluid pressure for operating the cylinders associated with the backhoe 12. Of course, it is understood that the tractor shown in FIG. 1 is an example of one type of mobile construction machine upon which the system constructed in accordance with the present invention may be utilized and the backhoe is one type of tool that it can be utilized with.

A hydraulic line 32 is connected from the output of the hydraulic pump 26 and fed to a loader valve 34 that is used for manipulating the front end loader 10. Extending from the loader valve 34 is a high pressure hydraulic line 36 that connects to the input of the backhoe loader valve 38. Positioned on top of the loader valve 38 are the levers 18, only one being shown in FIG. 2 for purposes of clarity, which are manipulated for controlling the flow of hydraulic fluid to the respective cylinders for manipulating the backhoe.

By manipulating the levers 18 forming part of the conventional valve 38, hydraulic pressure is supplied through hydraulic lines to the conventional cylinders provided on the backhoe. As shown in FIG. 1, there is a conventional boom cylinder 40, crowd cylinder 42, dipper cylinder 44 and two swing cylinders 46 to which hydraulic fluid is selectively supplied for manipulating the backhoe. Under a heavy load, it is desired that the hydraulic pump 26 be driven at a higher rate in order to increase the pressure supplied to each of these cylinders. This is accomplished by either manually moving the lever arm 20 for the injection pump 22 or automatically moving the lever 20 by a system constructed in accordance with the present invention.

A low pressure hydraulic line 60 is connected between the opposite side of the valve 38 from the high pressure line 36 and the hydraulic reservoir 28.

A double action cylinder 62 is provided for manipulating the throttle lever 20 responsive to changes in hydraulic pressure flowing through high pressure line 36. These changes occur responsive to the operator manually manipulating the levers 18 associated with the valve 38 for supplying hydraulic fluid to the various work cylinders associated with the backhoe 12. The double acting cylinder 62 has a pair of ports 64 and 66 located adjacent opposite ends of cylinder 62. A piston 68 is carried in the cylinder 62 and a piston rod 70 extends out of the cylinder and is connected to the lever arm 20 for regulating the flow of fuel to the engine. As can be seen in FIG. 3, bypass passages 72 extend through the piston for allowing fluid to flow from one side of the piston to the other at a regulated rate. As a result of the bypass passages extending through the piston, the response time of movement of the piston responsive to changes in pressure within the cylinder can be controlled and speeded up. While passageways are shown as providing communication between opposed sides of the piston 68, it is to be understood that clearance or grooves could be provided between the piston and the inner wall of the cylinder for accomplishing the same bypass of fluid responsive to movement of the piston 68.

The port 66 for the cylinder 62 is connected through a regulating valve 74 which, in turn, is connected through still another regulating valve 76 interposed between hydraulic line 78 and hydraulic line 36. A third regulating valve 80 is connected between a junction 82 and hydraulic line 78 and the reservoir 28.

The purpose of the valve 76 is to completely disengage the operation of the cylinder 62 from the system upon being closed.

The purpose of the valves 74 and 80 is to provide a balanced flow of fluid between the high pressure hydraulic lines 36 and either the cylinder 62 or the reservoir 28. By adjusting the valves 80 and 74, you can obtain the desired response time for the cylinder 62 and, in turn, movement of the lever 20 and also the holding time of the lever 20 responsive to release of the lever arm 18 connected with the valve 38. In other words, the throttle lever 20 is held in an accelerated position from one to twenty seconds depending on the balancing of the valves 74 and 80.

The normal flow of fluid under no load conditions is from the load valve 34 through the valve 38 and out of low pressure hydraulic line 60 back to the reservoir 28. However, when it is desired to lift a load, the lever 18 is moved. Upon movement of the lever 18, the fluid coming from the load valve 34 flows through the valve 38 and to the boom cylinder 40 for manipulating the boom. Simultaneously with this increase of high pressure flowing to the boom cylinder 40, some of the high pressure fluid is diverted through valves 76 and 74 to the input port 66 of the double acting cylinder 62. As the high pressure fluid flows through input port 66 the piston 68 is displaced to the left as shown in FIG. 3 which causes the throttle lever 20 to be moved speeding up the engine and thus increasing the output of hydraulic pump 26. If at this time the lever 18 is brought back to its neutral position, the fluid will then return directly to the reservoir 28 through the low pressure line 60. As a result, the pressure of the hydraulic fluid flowing through the high pressure line 36 drops until it becomes balanced with the pressure of the fluid flowing through the low pressure line 30 to the input of pump 26. The lever arm 20 pressing against the piston rod 70, tends to shift the piston to the right in cylinder 62 shown in FIG. 3. The rate that it is shifted to the right is controlled by the flow of fluid through the bypass passages 72. Thus, the engine 24 will continue running at a speed above its normal idle speed for a period of time from one to twenty seconds, depending on the balancing of the valves 74 and 80.

While a preferred embodiment of the invention has been described using specific terms, such description is for illustrative purposes only, and it is to be understood that changes and variations may be made without departing from the spirit or scope of the following claims.

What is claimed is:

1. A system for automatically regulating the fuel supplied to an engine of a mobile construction machine including a hydraulic pump driven by said engine, a tool carried by said machine for performing work functions, at least one hydraulic cylinder for manipulating said tool responsive to pressurized fluid being supplied to said hydraulic cylinder from said hydraulic motor, a reservoir of hydraulic fluid, hydraulic lines providing communication between said reservoir, hydraulic motor and said hydraulic cylinder, a manually operated valve mechanism for controlling the flow of hydraulic fluid between said hydraulic pump and said hydraulic cylinder, and a lever arm for regulating the flow of fuel to said engine, the improvement comprising:

a double action cylinder having:

(i) fluid ports adjacent opposed ends of said cylinder;

(ii) a piston carried in said double action cylinder;

(iii) a piston rod carried by said piston extending out of one end of said cylinder;

means connecting said piston rod to said lever arm for moving said lever arm responsive to the movement of said piston in said double action cylinder;

a hydraulic line connected between said valve mechanism and said hydraulic pump and one of said fluid ports of said double action cylinder for shifting said piston responsive to movement of said manually operated valve mechanism;

bypass openings provided in said double action cylinder for allowing a bleed-through of fluid from one side of said piston to the opposed side for minimizing the response time for movement of said piston responsive to pressurized hydraulic fluid being supplied to said hydraulic cylinder;

whereby said piston causes said lever arm to be moved for regulating the flow of fuel to said engine responsive to the flow of hydraulic fluid being supplied to said hydraulic cylinder.

2. The system as set forth in claim 1 further comprising:

means for connecting said other port of said double action cylinder to said reservoir of hydraulic fluid.

3. The system as set forth in claim 2 further comprising:

a first valve interposed in said hydraulic line connected between said manually operated valve mechanism and said hydraulic pump and said one of said ports;

another hydraulic line connected between said first valve and said reservoir;

a second valve interposed in said another hydraulic line;

means for selectively opening said first and second valves for controlling the flow of hydraulic fluid to said double action cylinder and said reservoir.

4. A system for automatically regulating the fuel supplied to an engine of a mobile construction machine including a hydraulic pump driven by said engine, a tool carried by said machine for performing work functions, at least one tool control hydraulic cylinder for manipulating said tool responsive to pressurized fluid being supplied to said tool control hydraulic cylinder from said hydraulic pump a reservoir of hydraulic fluid, a tool control hydraulic line connecting said hydraulic pump to said tool control hydraulic cylinder, a manually operated valve mechanism for controlling the flow of hydraulic fluid between said hydraulic pump and said tool control hydraulic cylinder, and a lever arm for regulating the flow of fuel to said engine, the improvement comprising:

a double action cylinder having:

(i) fluid ports adjacent opposed ends of said cylinder;

(ii) a piston carried in said double action cylinder;

(iii) a piston rod carried by said piston extending out one end of said cylinder;

means for connecting said piston rod to said lever arm for varying the flow of fuel to said engine response to the movement of said piston in said double action cylinder;

a high pressure hydraulic line extending from said tool control hydraulic line to one port of said double action cylinder causing said piston to move responsive to changes in hydraulic pressure to said tool control hydraulic cylinder;

a low pressure hydraulic line extending from said other port of said double action cylinder and said reservoir, and a hydraulic fluid bypass means providing fluid communication from one side of said piston to the other side of said piston for permitting said lever arm to be manually shifted without adverse interference from said double action cylinder for regulating the flow of fuel to said engine.

5. The system as set forth in claim 4 further comprising:

said hydraulic fluid bypass means being at least one bore extending through said piston.

6. A system for automatically regulating the fuel supplied to an engine of a mobile construction machine including a hydraulic motor driven by said engine, a tool carried by said machine for performing work functions, at least one tool control hydraulic cylinder for manipulating said tool responsive to pressurized fluid being supplied to said tool control hydraulic cylinder from said hydraulic pump a reservoir of hydraulic fluid, a tool control hydraulic line connecting said hydraulic pump to said tool control hydraulic cylinder, a manually operated valve mechanism for controlling the flow of hydraulic fluid between said hydraulic pump and said tool control hydraulic cylinder, and a lever arm for regulating the flow of fuel to said engine, the improvement comprising:

a double action cylinder having:

(i) fluid ports adjacent opposed ends of said cylinder;

(ii) a piston carried in said double action cylinder;

(iii) a piston rod carried by said piston extending out one end of said cylinder;

means for connecting said piston rod to said lever arm for varying the flow of fuel to said engine response to the movement of said piston in said double action cylinder;

a high pressure hydraulic line extending from said tool control hydraulic line to one port of said double action cylinder causing said piston to move responsive to changes in hydraulic pressure to said tool control hydraulic cylinder;

valve means interposed in said high pressure line for regulating the flow of hydraulic fluid to said one port of said hydraulic line;

a bypass line connected between said high pressure hydraulic line and said reservoir, and valve means interposed in said bypass line for controlling the flow of hydraulic fluid being drawn out of said hydraulic line and fed to said reservoir.

* * * * *